US012606759B2

(12) United States Patent
Blair et al.

(10) Patent No.: US 12,606,759 B2
(45) Date of Patent: Apr. 21, 2026

(54) SYSTEM AND METHOD FOR BLENDING HYDROGEN GAS

(71) Applicant: SAGEBRUSH PIPELINE EQUIPMENT CO., LLC, Tulsa, OK (US)

(72) Inventors: Thomas A Blair, Naperville, IL (US); Karthikk Sridharan, Bixby, OK (US); David E Gilmore, Glenpool, OK (US)

( * ) Notice: Subject to any disclaimer, the term of this patent is extended or adjusted under 35 U.S.C. 154(b) by 287 days.

(21) Appl. No.: 18/143,416

(22) Filed: May 4, 2023

(65) Prior Publication Data

US 2023/0357657 A1 Nov. 9, 2023

Related U.S. Application Data

(60) Provisional application No. 63/338,635, filed on May 5, 2022.

(51) Int. Cl.
*C10L 3/10* (2006.01)

(52) U.S. Cl.
CPC ..... *C10L 3/10* (2013.01); *C10L 2200/0277* (2013.01); *C10L 2200/0469* (2013.01); *C10L 2290/56* (2013.01); *C10L 2290/58* (2013.01); *C10L 2290/60* (2013.01)

(58) Field of Classification Search
CPC .... C10L 3/10; C10L 2290/58; C10L 2290/56; C10L 2200/0469; C10L 2290/60; C10L 2200/0277; G05D 11/132; C01B 3/02
See application file for complete search history.

(56) References Cited

U.S. PATENT DOCUMENTS

| | | | |
|---|---|---|---|
| 7,325,560 | B2 | 2/2008 | Arno et al. |
| 7,497,191 | B2 | 3/2009 | Fulton et al. |
| 7,740,031 | B2 | 6/2010 | Egan et al. |
| 7,752,848 | B2 | 7/2010 | Balan et al. |
| 8,418,732 | B2 | 4/2013 | Cohen |
| 8,469,009 | B2 | 6/2013 | Munshi et al. |
| 8,715,380 | B2 | 5/2014 | Apanel et al. |
| 8,784,516 | B2 | 7/2014 | Fischer et al. |
| 9,574,496 | B2 | 2/2017 | Fadde et al. |
| 9,666,435 | B2 | 5/2017 | Homan et al. |

FOREIGN PATENT DOCUMENTS

CN 203925808 U * 11/2014

* cited by examiner

*Primary Examiner* — Vishal V Vasisth
(74) *Attorney, Agent, or Firm* — D. Ward Hobson

(57) ABSTRACT

A system and method for automated blending of hydrogen gas with traditional fuels, such as natural gas, to produce a consistent stream of precision-blended flow with a single customizable, movable and modular unit that is automatically controlled, is disclosed. The system and method includes a self-contained modular unit, automatic flow control computers and systems, which are configured to automatically adjust the hydrogen blend for variable flow and pressures present in an existing distribution system, varying hydrogen and natural gas flow rates to maintain a repeatable percentage of hydrogen without manual operation.

10 Claims, 5 Drawing Sheets

SYSTEM AND METHOD FOR BLENDING HYDROGEN GAS

CROSS-REFERENCE TO RELATED APPLICATIONS

This application claims priority to U.S. Provisional Application No. 63/338,635, filed on May 5, 2022, which is expressly incorporated herein by reference in its entirety.

FIELD OF INVENTION

The invention is in the technical field of hydrogen gas blending. The invention pertains generally to systems and methods for blending hydrogen gas with another gas, such as natural gas, through a novel system and method as described herein.

BACKGROUND

Hydrogen (H2) represents a viable, renewable fuel, for transitioning from fossil fuels to green energy. The transition from fossil fuels to green energy such as hydrogen is likely to take place gradually over time and may be implemented in phases. Initially, the use of hydrogen in blends with other gases, such as natural gas, is likely to be an attractive way to introduce this green fuel into existing facilities. Unfortunately, however, traditional systems and methods for utilizing hydrogen, either as a stand-alone fuel or as a blended fuel are costly, inefficient, imprecise, and often unreliable. For example, traditional systems and methods for blending hydrogen with other gases are often not fully automated and do not deliver a precise, consistent, and reliable flow of blended hydrogen gas. Further, such traditional systems and methods are often expensive and inefficient to operate and maintain because they are not configured to be used with existing fossil fuel technology and infrastructure. It is critical to maintain a precise % H2 blend due to material compatibility issues and limitation of hydrogen concentration in downstream equipment with existing infrastructure. Traditional technologies also don't automatically adjust in real time because they aren't monitoring the % H2 in real time, and they aren't automatically adjusting the blend to change with changing conditions. Traditional systems and methods also are fixed in place and involve multi-step processes to shut down, change parameters, and start back up. Thus, making such traditional systems and methods cumbersome, difficult to use with existing technology, and inefficient. Thus, decreasing the usefulness of hydrogen as a viable, renewable fuel.

To that end it would be advantageous to provide an improved system and method for automated blending of hydrogen gas with traditional fuels, such as natural gas, to produce a consistent stream of usable flow. Thereby increasing the usefulness of hydrogen as a viable renewable fuel. The improved system and method described herein is a self-contained singular modular unit that includes automatic flow control computers, software, algorithms, and equipment configured to automatically adjust the hydrogen blend for variable flow and pressures present in an existing fuel distribution system, varying hydrogen and natural gas flow rates to maintain a desired repeatable ratio or desired percentage of hydrogen limit without manual operation. The improved system and method is configured as a stand-alone unit capable of installation and control by itself in an existing infrastructure. By monitoring the H2 blend concentration in real time and making precise adjustments in the blend to maintain that precision, adjusting automatically in real time, utilizing both feed forward and feedback control algorithms, the improved system and method provides the precision needed to utilize H2 blends in existing infrastructure, ensuring material compatibility. Also, the improved system and method does all this as a single, compact unit that can be mobilized to various points within any distribution system with ease. Traditional blending systems and methods using "feed-back" control to control hydrogen injection rates present challenges in catching up with the requested blend ratio as there is severe lag time in the feedback control. The improved system and method described herein includes both "feed-forward" and "feed-back" control systems which makes instantaneous and incremental changes as the flow and process changes without shutting down. The improved system and method also automatically calibrates daily to the existing natural gas composition, to ensure the precision blending desired. The improved system and method also contains integral blending turbulator(s) and stainless steel piping and components to ensure compatibility with hydrogen blends. Thus, providing numerous advantages over traditional systems and methods for blending hydrogen. It is to such an improved system and method that exemplary embodiments of the inventive concepts disclosed herein are directed.

SUMMARY OF THE INVENTION

Exemplary embodiments of the system and method for blending hydrogen gas disclosed herein include one or more system controllers, computers, programs, and algorithms, in combination with real-time and pre-set data, and one or more valves, pipes, blenders, and other equipment for blending, distributing, and transporting gas, including hydrogen gas, natural gas, and blends thereof. The system and method is configured to automatically adjust the hydrogen blend for variable flow and pressures present in an existing fuel distribution system. Thus, varying hydrogen and natural gas flow rates to maintain a repeatable ratio or percentage of hydrogen limit without manual operation. The system and method blends hydrogen with natural gas to produce a consistent stream of precision blended fuel. By using real-time data and intelligence related to the existing distribution system, the system and method automatically adjusts the hydrogen blend for optimal variable flow and pressures present in the distribution system. Thus, varying hydrogen and natural gas flowrates automatically to maintain a repeatable ratio or percentage or hydrogen limit without manual operation.

In accordance with an embodiment of the system and method disclosed herein, there is provided a system for blending hydrogen gas to produce a usable fuel, the system including: a plurality of pipe segments; one or more system controller; and a plurality of valves detachably connected to the plurality of pipe segments, the plurality of valves controlled by the system controller. The system controller automatically controls in real-time active flow of natural gas and active flow of hydrogen gas through the plurality of pipe segments to blend the hydrogen gas with the natural gas at a consistent blend of natural gas to hydrogen gas to produce a consistent stream of usable fuel. In some embodiments, the plurality of pipe segments includes at least one inlet for receiving natural gas from a natural gas source, at least one inlet for receiving hydrogen gas from a hydrogen gas source and at least one outlet for producing the consistent stream of usable fuel comprising the consistent blend of natural gas to hydrogen gas. In some embodiments, the system controller further includes a display screen and a control panel; the plurality of valves includes a hydrogen gas flow control valve controlled by the system controller; the plurality of valves includes a natural gas pressure control valve controlled by the system controller. In some embodiments, the system controller includes one or more precision flow meters in communication with the system controller. In some embodiments, the system further includes an inlet pressure regulator for controlling hydrogen inlet pressure and in some embodiments the system further includes a hydrogen analyzer controlled by the system controller.

In some embodiments, the system controller is a programmable logic controller having an automated software program running thereon. The automated software program programmed for providing customizable, modular, pre-programmed and custom programmed settings for automatically and selectively controlling real-time active flow of natural gas and real time active flow of hydrogen gas utilizing active real time feed-back data and active real time feed-forward data and pre-set data to blend hydrogen gas with natural gas at the consistent blend of natural gas to hydrogen gas to produce the consistent stream of usable fuel. In some embodiments, the consistent blend of natural gas to hydrogen gas is 0-100% while in other embodiments the typical percentage of hydrogen gas to natural gas is 5-25%.

In some embodiments, the system is a movable modular system for blending hydrogen gas to produce a consistent stream of usable fuel. The system includes: a system of detachably connected pipe segments for transporting and blending hydrogen gas and natural gas. The system of detachably connected pipe segments having at least one inlet for receiving natural gas from a natural gas source, at least one inlet for receiving hydrogen gas from a hydrogen gas source and at least one outlet for producing a consistent stream of usable fuel comprising a consistent blend of natural gas to hydrogen gas. The system further includes a programmable logic system controller having a display screen and control panel. The programmable logic system controller detachably connected to the system of detachably connected pipe segments. The programmable logic system controller programmed for providing customizable, modular, pre-programmed and custom programmed settings for automatically and selectively controlling real-time active flow of natural gas and hydrogen gas and for blending hydrogen gas with natural gas at the consistent blend of natural gas to hydrogen gas to produce the consistent stream of usable fuel. The system includes a hydrogen gas flow control valve controlled by the programmable logic system controller. The hydrogen gas flow control valve detachably connected to the system of detachably connected pipe segments and configured for regulating hydrogen gas flow. The system includes a natural gas pressure control valve controlled by the programmable logic system controller. The natural gas pressure control valve detachably connected to the system of detachably connected pipe segments and configured for regulating natural gas pressure to a pre-set value.

The system further includes one or more precision flow meters in communication with the programmable logic system controller, the precision flow meters detachably connected to the system of detachably connected pipe segments. The precision flow meters for measuring mass flow of natural gas and mass flow of hydrogen gas and communicating data to the programmable logic system controller. The system includes an inlet pressure regulator detachably connected to the system of detachably connected pipe segments. The inlet pressure regulator for regulating inlet natural gas pressure and inlet hydrogen gas pressure. The system further includes a hydrogen analyzer controlled by the programmable logic system controller. The hydrogen analyzer detachably connected to the system of detachably connected pipe segments, the hydrogen analyzer for measuring hydrogen concentration.

In some embodiments the consistent blend of natural gas to hydrogen gas is 0-100% while in other embodiments the typical percentage of hydrogen gas to natural gas is 5-25%. In some embodiments, the programmable logic system controller includes an automated software program running on the programmable logic system controller. The automated software program programmed for providing customizable, modular, pre-programmed and custom programmed settings for automatically and selectively controlling real-time active flow of natural gas and real time active flow of hydrogen gas utilizing active real time feed-back data and active real time feed-forward data and pre-set data to blend hydrogen gas with natural gas at the consistent blend of natural gas to hydrogen gas to produce the consistent stream of usable fuel.

In some embodiments, a method of blending hydrogen gas to produce a consistent stream of usable fuel is disclosed. The method includes the steps of: (i) providing a movable modular system for blending hydrogen gas to produce a consistent stream of usable fuel as described above; (ii) opening the natural gas pressure control valve from the programmable logic system controller of the movable modular system and maintaining a constant set discharge pressure on the programmable logic system controller of the movable modular system; (iii) calibrating the hydrogen analyzer and setting the hydrogen analyzer flow control loop on the programmable logic system controller based on daily natural gas composition; (iv) confirming on the programmable logic system controller that constant natural gas discharge pressure and flowrate is achieved so that the movable modular system is ready for hydrogen injection and blending; (v) selecting a blend percentage of hydrogen gas and natural gas on the programmable logic system controller; (vi) opening the hydrogen gas flow control valve from the programmable logic system controller and activating the hydrogen analyzer flow control loop on the programmable logic system controller; (vii) once the hydrogen flow stabilizes, confirming on the programmable logic system controller the blend of hydrogen gas to natural gas from the hydrogen analyzer; and (viii) producing from the movable modular system a consistent stream of usable fuel at the consistent blend of natural gas to hydrogen gas.

In some embodiments of the method, the consistent blend of natural gas to hydrogen gas is 0-100%; while in other embodiments of the method the typical percentage of hydrogen gas to natural gas is 5-25%. In some embodiments, the method includes the step of providing hydrogen gas from a hydrogen source and the step of providing natural gas from a natural gas source. Further, in some embodiments the method further includes the step of automatically and selectively controlling real-time active flow of natural gas and automatically and selectively controlling the real time active flow of hydrogen gas utilizing active real time feed-back data and active real time feed-forward data and pre-set data from the movable modular system to blend hydrogen gas with natural gas at the consistent blend of natural gas to hydrogen gas to produce the consistent stream of usable fuel.

In accordance with an embodiment of the system and method disclosed herein, there is provided an automated active flow control hydrogen gas and natural gas blender system. The system is equipped with standard safety and control functions, including one or more computers, stainless-steel construction, auto-flow-controls, class I division 1 group D location suitability (classifications for atmospheres containing hazardous elements) suitability, independent gas flow meters, independent pressure transmitters, integral automated control valves, and one or more control system to precisely regulate and monitor the hydrogen blend and communicate with existing controls, equipment and infrastructure. Whether the hydrogen comes from a gray, blue, or green source ("gray" refers to hydrogen that is derived from fuels such as natural gas using an energy intensive process that emits carbon dioxide, while "blue" hydrogen is sometimes referred to as a clean alternative because it emits less carbon dioxide, while "green" hydrogen refers to hydrogen that is produced from a method involving negligible carbon dioxide production), the system and method disclosed herein provides maximum flexibility to utilize hydrogen blends in existing infrastructure.

In accordance with an embodiment of the system and method disclosed, a combined "feed-forward" and "feed-back" control strategy is utilized. Simultaneously, actual real-time flow through the system is compared with the calculated theoretical flow required to provide the user-defined hydrogen blend. The system performs this fine tuning with an immediate process response cycle time to automatically adjust the blend. No operator attention or time consuming "change overs" between trains and equipment are required.

In accordance with an embodiment of the system and method disclosed, the active flow control delivers an accurate hydrogen blend instantaneously upon start up and under rapid load changes. When the active flow control is started, the natural gas flow meter sends a value to the control system, which pre-determines the position of the natural gas fuel flow control valve relative to the natural gas flow rate. The active flow control is then online using the downstream measurement of the H2 in the gas to make fine-tuned adjustments as steady state is achieved. Consistent, reliable blended fuel gas is produced and the system and method is capable of changing the blend "on the fly" in "real-time" either on the system itself or remotely via one or more computers and internet connections, and at varying flow rates and pressures for use within existing production, utility distribution, or in new facility construction.

In accordance with an embodiment of the system and method disclosed, the active flow control mixes hydrogen and natural gas at a specific ratio to produce a repeatable, reliable hydrogen gas blend. Pressure and temperature compensated flow meters, measure the regulated flow of hydrogen and natural gas. The volumetric or mass flow of both gas streams are converted to their true molar values with a sophisticated gas flow algorithm that takes into account the system process conditions. The ratio of the flow rates is then compared to the required ratio for the user-controlled blend desired.

In accordance with an embodiment of the system and method disclosed, adjustments to the ratio are made on the hydrogen side of the system. Adjustments are automatic and are performed by the automated flow control valve. The outlet inline analyzer feeds back the actual hydrogen content of the total blended flow rate, so the programmable logic controller (also referred to herein as a computer or as the "PLC") can calculate the correct Vol % of H2, relative to current system conditions, and relative gas densities, and makes fine adjustments to the control valve to maintain the desired percent or ratio of hydrogen limit that has been set by the user. As the demand for blended gas either increases or decreases, the flow control valve modulates to maintain a consistent mixing ratio between the hydrogen and conventional fuel streams. Manual or automatic adjustments of the mixing ratio are performed from the PLC display screen or touch screen of the HMI (Human Machine Interface) of the active flow control and can be interfaced with any DCS (Distributed Control System) for remote operation and ease of use with existing technology and infrastructure.

In accordance with another embodiment of the system and method disclosed, there is provided a method of blending hydrogen gas and operation. The method includes the steps of: (i) confirming system isolation valves are open; (ii) confirming sufficient power (preferably, at least 120V/3/60) is available to the PLC; (iii) confirming PLC panel e-stop is pulled in so that the PLC is ready for use; (iv) allowing HMI and PLC panel to come online using the internet, intranet or other communications systems; (v) opening the natural gas pressure control valve from the PLC and maintaining constant set discharge pressure (preferably, at least 100 psig); (vi) calibrating the hydrogen analyzer based on the daily natural gas composition; (vii) once constant natural gas discharge pressure and flowrate is achieved, the system is ready for hydrogen injection and blending; (viii) selecting the desired volumetric blend percentage in the PLC HMI display screen; (x) opening the hydrogen gas flow control valve from PLC with active flow control loop activated; and (xiii) if, one of the safety shutdown conditions exceeds its set point, the system will shut down blending and send an alarm to the one or more control system or systems (including, for example, any distributed control system (DCS)/programmable logic controller (PLC)/remote terminal unit (RTU)/supervisory control and data acquisition system (SCADA)).

BRIEF DESCRIPTION OF THE SEVERAL VIEWS OF THE DRAWINGS

Like reference numerals in the figures represent and refer to the same or similar element or function. Implementations of the disclosure may be better understood when consideration is given to the following detailed description thereof. Such description makes reference to the annexed pictorial illustrations, schematics, graphs, drawings, and appendices. In the drawings.

DETAILED DESCRIPTION OF EXEMPLARY EMBODIMENTS

Figure 1A:
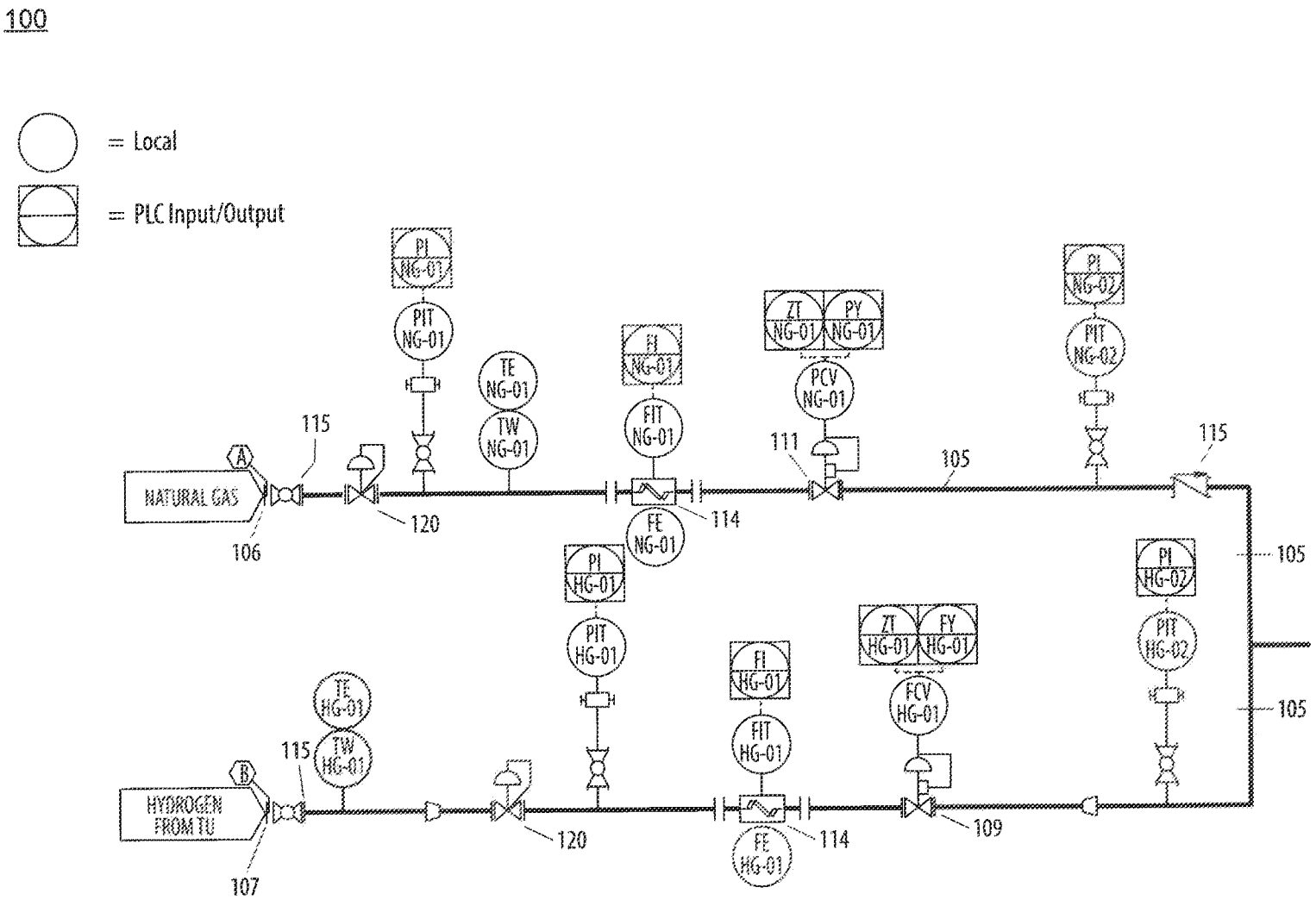
FIG. 1*a* is a diagram of an exemplary embodiment of a system of blending hydrogen gas according to the inventive concepts disclosed herein.

Before explaining at least one embodiment of the inventive concepts disclosed herein in detail, it is to be understood that the inventive concepts are not limited in their application to the details of construction and the arrangements of the components or steps or methodologies set forth in the following description or illustrated in the drawings. The inventive concepts disclosed herein are capable of other embodiments or of being practiced or carried out in various ways. Also, it is to be understood that the phraseology and terminology employed herein is for the purpose of description and should not be regarded as limiting the inventive concepts disclosed herein in any way.

In the following detailed description of embodiments of the inventive concepts, numerous specific details are set forth in order to provide a more thorough understanding of the inventive concepts. However, it will be apparent to one of ordinary skill in the art that the inventive concepts within the disclosure may be practiced without these specific details. In other instances, well-known features have not been described in detail to avoid unnecessarily complicating the instant disclosure.

As used herein, the terms "comprises," "comprising," "includes," "including," "has," "having," or any other variation thereof, are intended to cover a non-exclusive inclusion. For example, a system, assembly, method, process, article, or apparatus that comprises a list of elements or steps is not necessarily limited to only those elements or steps but may include other elements and steps not expressly listed.

Further, unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concepts. This description should be read to include one or at least one and the singular also includes the plural, i.e., more than one, unless it is obvious that it is meant otherwise.

Finally, as used herein any reference to "one embodiment" or "an embodiment" means that a particular element, feature, structure, or characteristic described in connection with the embodiment is included in at least one embodiment. The appearances of the phrase "in one embodiment" in various places in the specification are not necessarily all referring to the same embodiment.

Figure 1B:
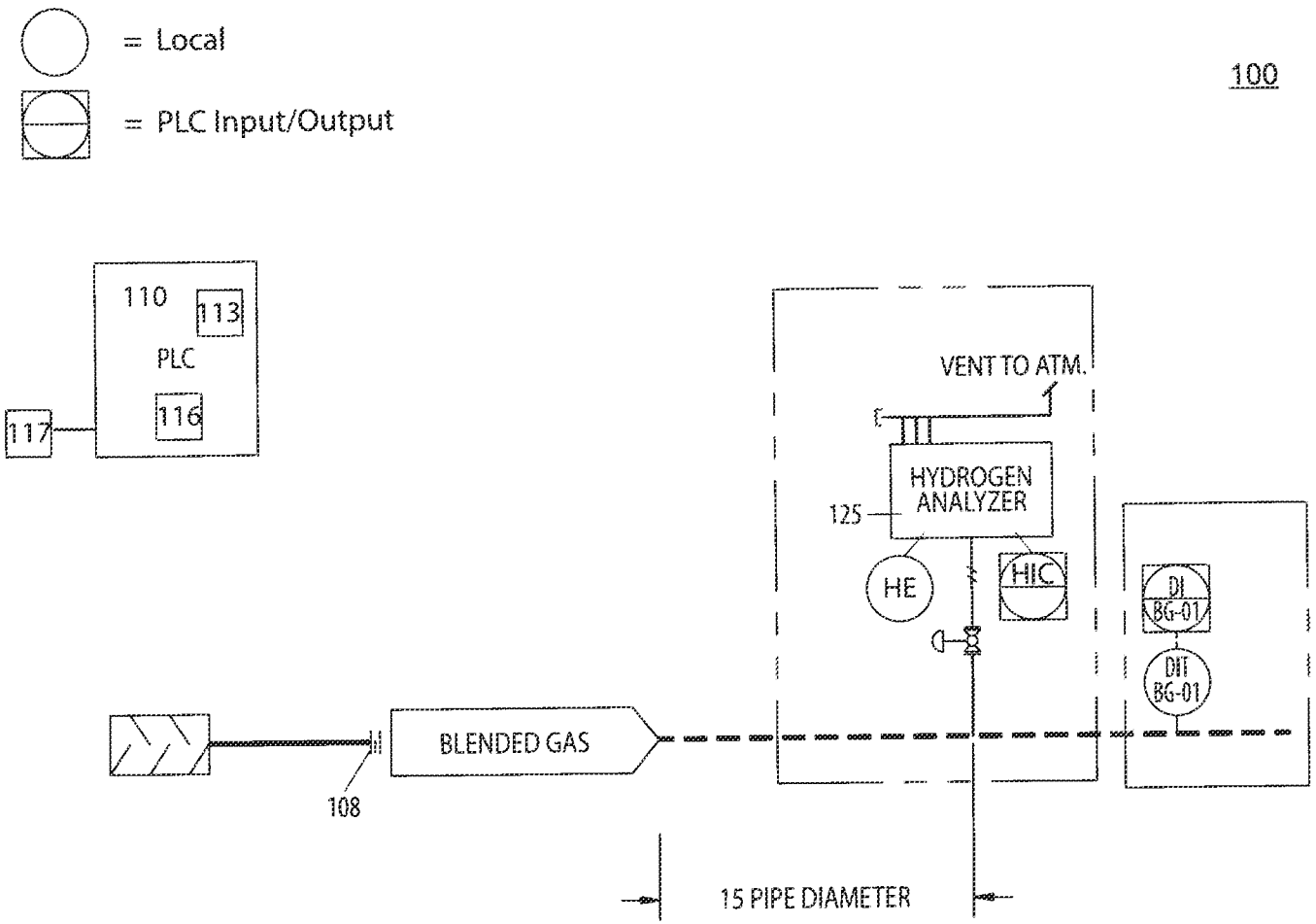
FIG. 1*b* is a diagram of an exemplary embodiment of a system of blending hydrogen gas according to the inventive concepts disclosed herein.
Figure 2:
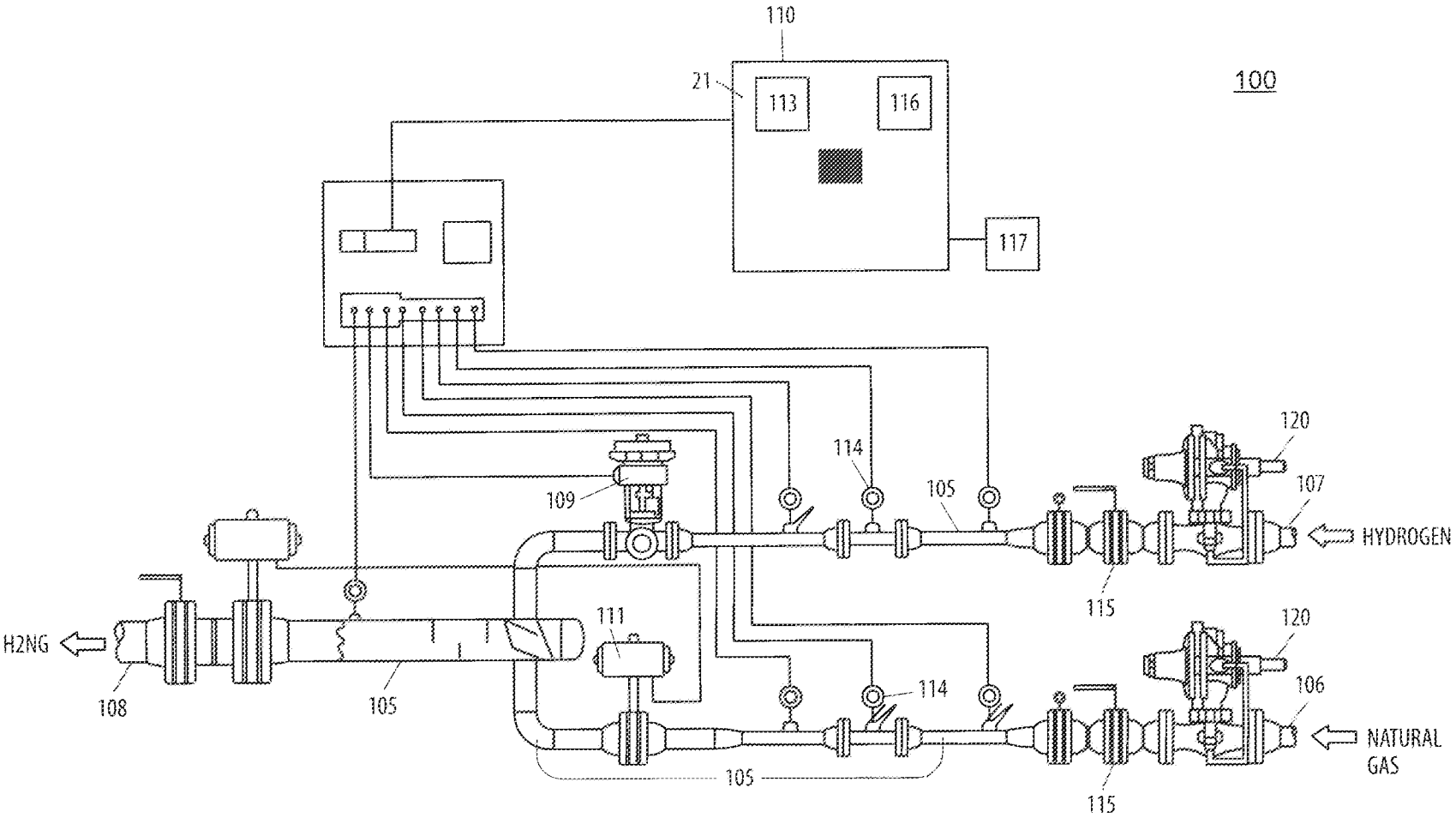
FIG. 2 is a perspective view of an exemplary embodiment of a system of blending hydrogen gas according to the inventive concepts disclosed herein.
Figure 3:
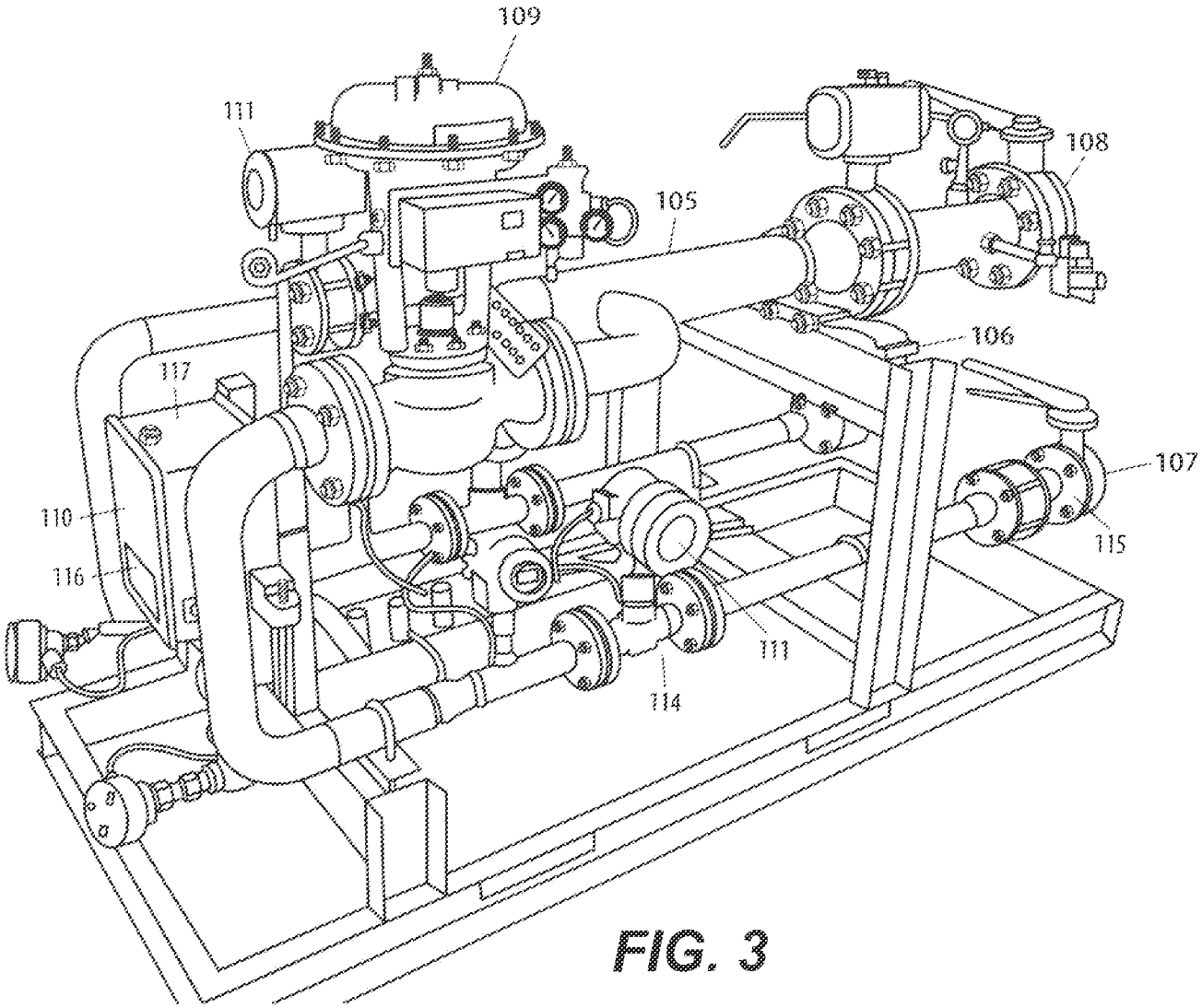
FIG. 3 is a perspective view of an exemplary embodiment of a system of blending hydrogen gas according to the inventive concepts disclosed herein.

Referring now to FIGS. 1-4, shown therein are exemplary embodiments of the system and method for blending hydrogen gas described and claimed herein. FIGS. 1-3 depict a system (100) for blending hydrogen gas to produce a usable fuel. The system (100) includes a plurality of pipe segments (105); one or more system controller (110); and a plurality of valves (115) detachably connected to the plurality of pipe segments (105). The plurality of valves (115) controlled by the system controller (110). The system controller (110) automatically controls in real-time active flow of natural gas and active flow of hydrogen gas through the plurality of pipe segments (105) to blend the hydrogen gas with the natural gas at a consistent blend of natural gas to hydrogen gas to produce a consistent stream of usable fuel.

In some embodiments of the system (100) the plurality of pipe segments (105) further includes at least one inlet (106) for receiving natural gas from a natural gas source, at least one inlet (107) for receiving hydrogen gas from a hydrogen gas source and at least one outlet (108) for producing the consistent stream of usable fuel comprising the consistent blend of natural gas to hydrogen gas. Further, in some embodiments, the system controller (110) further includes a display screen (116) and a control panel (117). In some embodiments, the plurality of valves (115) further includes a hydrogen gas flow control valve (109) controlled by the system controller (110) while in some embodiments the plurality of valves (115) further includes a natural gas pressure control valve (111) controlled by the system controller (110). In some embodiments, the system (100) further includes one or more precision flow meters (114) in communication with the system controller (110). In some embodiments, the system (100) further includes an inlet pressure regulator (120) for controlling hydrogen inlet pressure. In some embodiments, the system (100) further includes a hydrogen analyzer (125) controlled by the system controller (110).

In some embodiments, the system controller (110) is a programmable logic controller having an automated software program (113) running thereon. The automated software program (113) programmed for providing customizable, modular, pre-programmed and custom programmed settings for automatically and selectively controlling real-time active flow of natural gas and real time active flow of hydrogen gas utilizing active real time feed-back data and active real time feed-forward data and pre-set data to blend hydrogen gas with natural gas at the consistent blend of natural gas to hydrogen gas to produce the consistent stream of usable fuel. In some embodiments, the consistent blend of natural gas to hydrogen gas is 0-100% and typically, the percentage of hydrogen gas to natural gas is 5-25%.

In some embodiments, the movable modular system (100) for blending hydrogen gas to produce a consistent stream of usable fuel includes a system of detachably connected pipe segments (105) for transporting and blending hydrogen gas and natural gas. The system of detachably connected pipe segments having at least one inlet (106) for receiving natural gas from a natural gas source, at least one inlet (107) for receiving hydrogen gas from a hydrogen gas source and at least one outlet (108) for producing a consistent stream of usable fuel comprising a consistent blend of natural gas to hydrogen gas. The system (100) including a programmable logic system controller (110) having a display screen (116) and control panel (117). The programmable logic system controller (110) detachably connected to the system of detachably connected pipe segments (105). The programmable logic system controller (110) programmed for providing customizable, modular, pre-programmed and custom programmed settings for automatically and selectively controlling real-time active flow of natural gas and hydrogen gas and for blending hydrogen gas with natural gas at the consistent blend of natural gas to hydrogen gas to produce the consistent stream of usable fuel. The system (100) includes a hydrogen gas flow control valve (109) controlled by the programmable logic system controller (110). The hydrogen gas flow control valve (109) detachably connected to the system of detachably connected pipe segments (105) and configured for regulating hydrogen gas flow. The system (100) includes a natural gas pressure control valve (111) controlled by the programmable logic system controller (110). The natural gas pressure control valve (111) detachably connected to the system of detachably connected pipe segments (105) and configured for regulating natural gas pressure to a pre-set value.

The system (100) further includes one or more precision flow meters (114) in communication with the programmable logic system controller (110). The precision flow meters (114) detachably connected to the system of detachably connected pipe segments (105). The precision flow meters (114) for measuring mass flow of natural gas and mass flow of hydrogen gas and communicating data to the programmable logic system controller (110). The system (100) further includes an inlet pressure regulator (120) detachably connected to the system of detachably connected pipe segments (105). The inlet pressure regulator (120) for regulating inlet natural gas pressure and inlet hydrogen gas pressure. The system (100) further includes a hydrogen analyzer (125) controlled by the programmable logic system controller (110). The hydrogen analyzer (125) detachably connected to the system of detachably connected pipe segments (105). The hydrogen analyzer (125) for measuring hydrogen concentration.

In some embodiments of the movable modular system (100) the consistent blend of natural gas to hydrogen gas is 0-100%; while in some embodiments, the typical percentage of hydrogen gas to natural gas is 5-25%. In some embodiments, the programmable logic system controller (110) further includes an automated software program (113) running on the programmable logic system controller (110). The automated software program (113) programmed for providing customizable, modular, pre-programmed and custom programmed settings for automatically and selectively controlling real-time active flow of natural gas and real time active flow of hydrogen gas utilizing active real time feed-back data and active real time feed-forward data and pre-set data to blend hydrogen gas with natural gas at the consistent blend of natural gas to hydrogen gas to produce the consistent stream of usable fuel.

Figure 4:
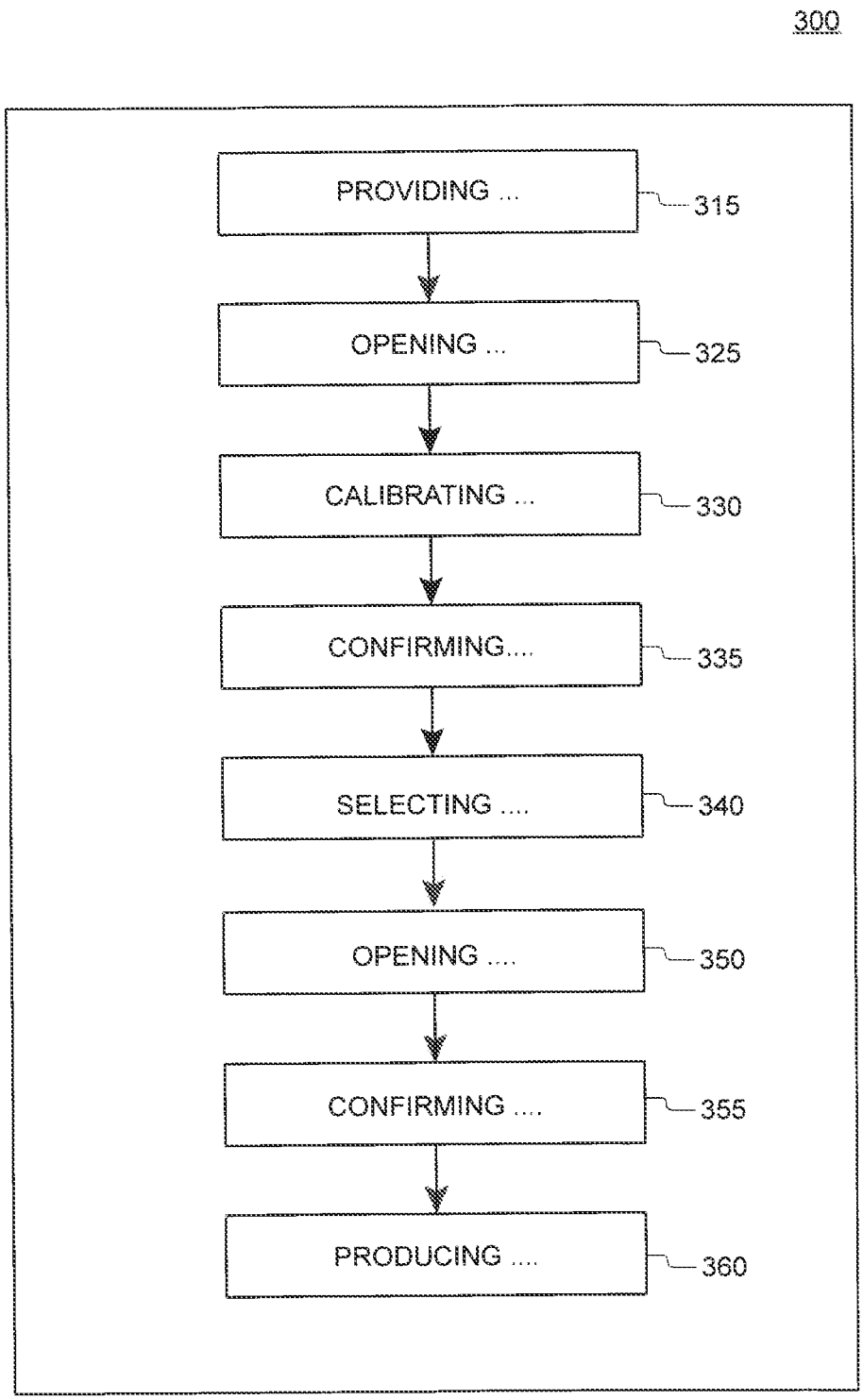
FIG. 4 is a diagram of an exemplary embodiment of a method of blending hydrogen gas according to the inventive concepts disclosed herein.

Referring now to FIG. 4, shown therein is a method (300) of blending hydrogen gas with natural gas to produce a consistent stream of usable fuel. The method (300) including the step of: (i) providing (315) a movable modular system (100) (as shown in FIGS. 1-3) for blending hydrogen gas to produce a consistent stream of usable fuel. The system (100) as described herein and including a system of detachably connected pipe segments (105) for transporting and blending hydrogen gas and natural gas. The system of detachably connected pipe segments having at least one inlet (106) for receiving natural gas from a natural gas source, at least one inlet (107) for receiving hydrogen gas from a hydrogen gas source, and at least one outlet (108) for producing a consistent stream of usable fuel comprising a consistent blend of natural gas to hydrogen gas. The system (100) includes a programmable logic system controller (110) having a display screen (116) and control panel (117). The programmable logic system controller (110) detachably connected to the system of detachably connected pipe segments (105). The programmable logic system controller (110) programmed for providing customizable, modular, pre-programmed and custom programmed settings for automatically and selectively controlling real-time active flow of natural gas and hydrogen gas and for blending hydrogen gas with natural gas at the consistent blend of natural gas to hydrogen gas to produce the consistent stream of usable fuel.

The system (100) further including a hydrogen gas flow control valve (109) controlled by the programmable logic system controller (110). The hydrogen gas flow control valve (109) detachably connected to the system of detachably connected pipe segments (105) and configured for regulating hydrogen gas flow. The system (100) including a natural gas pressure control valve (111) controlled by the programmable logic system controller (110). The natural gas pressure control valve (111) detachably connected to the system of detachably connected pipe segments (105) and configured for regulating natural gas pressure to a pre-set value. The system (100) including one or more precision flow meters (114) in communication with the programmable logic system controller (110), the precision flow meters (114) detachably connected to the system of detachably connected pipe segments (105), the precision flow meters (114) for measuring mass flow of natural gas and mass flow of hydrogen gas and communicating data to the programmable logic system controller (110). The system (100) including an inlet pressure regulator (120) detachably connected to the system of detachably connected pipe segments (105). The inlet pressure regulator (120) for regulating inlet natural gas pressure and inlet hydrogen gas pressure. The system (100) including a hydrogen analyzer (125) controlled by the programmable logic system controller (110). The hydrogen analyzer (125) detachably connected to the system of detachably connected pipe segments (105). The hydrogen analyzer for measuring hydrogen concentration.

The method (300) further including the steps of (ii) opening (325) the natural gas pressure control valve (111) from the programmable logic system controller (110) of the movable modular system (100) and maintaining a constant set discharge pressure on the programmable logic system controller (110) of the movable modular system (100). The method (300) further including the step of (iii) calibrating (330) the hydrogen analyzer (125) and setting the hydrogen analyzer flow control loop on the programmable logic system controller (110) based on daily natural gas composition. The method (300) further including the step of (iv) confirming (335) on the programmable logic system controller (110) that constant natural gas discharge pressure and flowrate is achieved so that the movable modular system (100) is ready for hydrogen injection and blending. The method (300) further including the step of (v) selecting (340) a blend percentage of hydrogen gas and natural gas on the programmable logic system controller (110). The method (300) further including the step of (vi) opening (350) the hydrogen gas flow control valve (109) from the programmable logic system controller (110) and activating the hydrogen analyzer (125) flow control loop on the programmable logic system controller (110). Further, the method (300) includes the step of (vii) once the hydrogen flow stabilizes, confirming (355) on the programmable logic system controller (110) the blend of hydrogen gas to natural gas from the hydrogen analyzer (125). The method (300) further includes the step of (viii) producing (360) from the movable modular system (100) a consistent stream of usable fuel at the consistent blend of natural gas to hydrogen gas.

In some embodiments of the method (300) the consistent blend of natural gas to hydrogen gas is 0-100%; while in some embodiments of the method (300) the percentage of hydrogen gas to natural gas is 5-25%. In some embodiments, the method (300) further includes the step of providing (360) hydrogen gas from a hydrogen source and the step of providing (370) natural gas from a natural gas source. Further, in some embodiments, the method (300) further includes the step of automatically and selectively controlling (375) real-time active flow of natural gas and automatically and selectively controlling the real time active flow of hydrogen gas utilizing active real time feed-back data and active real time feed-forward data and pre-set data from the movable modular system (100) to blend hydrogen gas with natural gas at the consistent blend of natural gas to hydrogen gas to produce the consistent stream of usable fuel.

As shown in FIGS. 1-4, key equipment and components of the system and method include, but are not limited to, pipes, housing, connection devices, pressure regulators, isolation valve, back flow check valve, pressure transmitters (pressure correction of the flow data), flow meters, temperature transmitters, hydrogen flow control valve (controls hydrogen flow based on flow and control parameters), fuel pressure control valve (controls natural gas pressure flow), turbulators (internal to header), pressure indicator (displays blended gas discharge pressure), pressure transmitter (provides blended gas discharge pressure signal to the control system), discharge safety valve (pneumatically opens—spring close), butterfly-type isolation valve, local junction box (mounted on the active flow control blender), Modbus/Ethernet (TCP/IP) or fiber optic communications cable, control panel (simple touch screen design, operator-friendly and compact), conventional fuel automatic safety valve, local junction box, blended fuel outlet, blended pressure transmitter, for example. Optional equipment may include further blended gas surge tank for sampling and testing, as well as an outlet flare for venting and destroying flammable gas.

The system may be constructed from any number and type of desired materials that are compatible with H2 gases, known to persons having ordinary skill in the art, including but not limited to, stainless steel, alloys, non-metals, composite materials, or combinations thereof. Further, the shape and configuration of the system may be any shape sufficient to fit to or within an existing facility or infrastructure. It is to be appreciated that each component of the system may be attached or detachably connected in any desired manner, including via welds, joints, flanges, seams, screws, nuts and bolts, adhesives, combinations thereof and the like. The system is ideally configured to be a comprehensive, customizable, modular and movable unit, including all necessary parts and components, software, hardware, and programming, such that it can be packaged and sold as a unit and mobilized to different locations within a customer pipeline network with ease. Further, within the system and method, the flowmeter, regulator, and flow control valve can be provided as a replaceable flanged module to aid in replacing piping should higher future flowrates be required and permitted.

Intelligent instruments of the system and method include, but are not limited to, computers, software, programs, wireless and wired internet accessibility equipment, and equipment for reducing or providing no analog scaling errors or drift, all data is transmitted directly to the PLC (programmable logic controller) via digital signal, and values are transmitted directly—which eliminates scaling errors. Advanced diagnostic information includes process values which are transmitted with a diagnostic byte to indicate signal quality and alarms which are triggered when signal quality is questionable thereby eliminating user guess work and improving safety and reliability.

Intelligent process controls of the system and method include, but are not limited to, computers, software, programs, and equipment for making an automatic calculation of mixing set-point to achieve the target hydrogen mix; automatic adjustment via a downstream hydrogen analyzer; adjustable alarm set-points and process responses via HMI screens; alarm messages with process value history; extensive process value display for process diagnostics; for each flow stream the automatic flow control can display, real-time pressure, temperature, actual flow, corrected flow at standard conditions, molar flow, stream velocity, volumetric ratio, and molar ratio; totalized flow at standard conditions; blended gas pressure; blended gas totalized flow at standard conditions; control valve throttle position; and real-time hydrogen percent of blended gas. Communication interfaces available include Profibus, Foundation Fieldbus, RS-232 (ASCII, 3964R, RS-485 (Modbus), and Ethernet (TCP/IP), or the communication interfaces may be customizable to the user's requirements. Additional optional equipment, may include, hydrogen supply compensation, DCS interface, inlet and discharge pressure regulators, electric actuation, instrument air package, surge tank, flare, quick connections, maintenance enclosure and a mobile trailer-mounted option.

True digital flow control valve positioning equipment ensures that the robust piezoelectric valve block is virtually wear proof and that minimum air consumption is required by the piezoelectric valves. The true digital flow control valve positioning provides for one touch, "push button" self-tuning of valve positioner, local display of controller set-point and valve position, and extended diagnostic information, for example. Robust flow measurement includes, but is not limited to, features that are immune to vibration to over 1 g in all axis, thermal shock greater than 150 K/s, and dirty media for example. Flow measurement also includes permanent self-monitoring and diagnostic of electronics and sensors. The system and method is configured to provide little to no maintenance, no moving parts, and no zero-point drift on the flow sensor.

The system and method described herein include various combinations of equipment including a variety of different "skids" for various component systems used with or in combination with the system and method described herein. As used herein the term "skid" refers to one or more system or systems comprising various equipment, parts or systems of the system and method described and claimed herein. For example, a skid may include a variety of valves, blenders, computers, software, and various other component parts of the system and method described herein, in combination with other skids or systems, and each skid may be assembled as a separate movable component system or part of the movable, modular, customizable, system and method descried herein and may be assembled with or without interconnecting pipe work. The active flow control skid of the system and method described herein regulates the natural gas pressure and blends with hydrogen as required by the specific blend (typically 5-30% to be utilized within existing infrastructure). The system is provided with pressure regulation control valves, precision flowmeters, such as Corolis flowmeters, a temperature element, and inlet and outlet pressure transmitter in the natural gas line. The hydrogen line in the active flow control blending skid is provided by the flow control valve, Corolis flowmeter, inlet pressure regulator, temperature element and inlet and outlet pressure transmitters. The blended gas line is provided with NOVA 8370N4-D2 or other equal hydrogen analyzer and, in some embodiments, a density meter to measure the hydrogen ratio and mixture density. All instruments and actuated valves are pre-wired to one or more PLC, such as an Allen-Bradley® ControlLogix PLC or equal which controls the blending skid.

In some, embodiments, for example, the active flow control skid on/off sequence of operation in the PLC is as shown below in Table 1 for example.

TABLE 1

| |
|---|
| PI-NG-01—ANALOG INPUT, 4-20 mA, Natural Gas Inlet pressure |
| TI-NG-01—ANALOG INPUT, K-type thermocouple (mV), Natural Gas Inlet Temperature |

TABLE 1-continued

| |
|---|
| FI-NG-01—ANALOG INPUT, 4-20 mA, Natural Gas Flow Rate |
| PY-NG-01—ANALOG INPUT, 4-20 mA, 0-100%, Natural Gas Pressure Demand |
| ZT-NG-01— ANALOG INPUT, 4-20 mA, 0-100%, Natural Gas Pressure Control Valve Position |
| PIC-NG-01—ANALOG OUTPUT, 4-20 mA, Natural Gas Pressure set point |
| PI-NG-02—ANALOG INPUT, 4-20 mA, Natural Gas Outlet Pressure |
| TI-HG-01—ANALOG INPUT, K-type Thermocouple (mV), Hydrogen Gas Inlet Temperature |
| PI-HG-01—ANALOG INPUT, 4-20 mA, Hydrogen Gas Regulated Pressure |
| FI-HG-01—ANALOG INPUT, 4-20 mA, Hydrogen Gas Flow Rate |
| FY-HG-01—ANALOG OUTPUT, 4-20 mA, 0-100%, Hydrogen Gas Flow Demand |
| ZT-HG-01—ANALOG INPUT, 4-20 mA, 0-100%, Hydrogen Gas Flow Control Valve Position |
| FIC-HG-01—ANALOG OUTPUT, 4-20 mA, Hydrogen Gas Flow Valve Controller |
| PI-HG-02—ANALOG INPUT, 4-20 mA, Hydrogen Gas Outlet Pressure |
| TI-BG-01—ANALOG INPUT, K-type Thermocouple (mV), Blended Gas Temperature |
| AI-BG-01—ANALOG INPUT, 4-20 mA, 0-100%, Blended Gas Hydrogen Vol % |
| DI-BG-01—ANALOG INPUT, 4-20 mA, Blended Gas Density |

For purposes of clarity, it should be understood that the terminology used above and herein of "PI-NG-01", "TI-NG-01" and the like, for example, is understood by one of ordinary skill in the art as short-hand abbreviations for various specific equipment and component parts of the system and method described herein, including, but not limited to, various valves, meters, blenders, controllers and the like. Such abbreviations are commonly understood and used by persons of ordinary skill in the art and therefore such abbreviations will not be further described herein for purposes of brevity and clarity in describing the inventive concepts of the system and method described and claimed herein. It should be understood, however, that any specific equipment abbreviations used and referenced herein are non-limiting and are used for descriptive and exemplary purposes only it being understood that various other specific equipment parts and systems may be used in combination with or in lieu of those specifically referenced herein and in accordance with the inventive concepts disclosed and claimed herein.

In some embodiments, the system and method includes a natural gas pressure regulating station. The natural gas pressure regulating station regulates natural gas pressure throughout a natural gas flow range. The natural gas pressure regulating station consists of one or more pressure regulation train. The pressure regulating station is controlled by the PLC, such as an Allen-Bradley® ControlLogix PLC using control valve and discharge pressure transmitter. Natural gas pressure control controls the pressure based on the set point and discharge pressure 4-20 mA signal (Process Variable) in the proportional integral derivative controller (PID) loop and the pressure PID controller 4-20 mA signal to the pressure control valve. The pressure control valve provides 4-20 mA valve position to the PLC.

In some embodiments, the system and method also includes the steps of operation in the PLC of: (i) PI-NG-02—ANALOG INPUT, 4-20 mA, Natural Gas Outlet Pressure; (ii) PI-NG-02>setpoint for 10 sec, (iii) Provides HMI ALARM—"NATURAL GAS DISCHARGE PRESSURE HIGH"; (iv) SHUTDOWN—PCV-NG-01 (PY-NG-01=4 mA); and (vi) SHUTDOWN—FCV-HG-01 (FY-HG-01=4 mA).

The natural Gas flow rate is measured by a flow meter and transmitter located upstream of the pressure control valve. Alarm points associated with this flow signal include: (i) FI-NG-01—ANALOG INPUT, 4-20 mA, Natural Gas Flow Rate; (ii) FI-NG-01<minimum flow, Natural Gas Flow Low: and (iii) HMI ALARM—"NATURAL GAS LOW FLOW". Natural Gas inlet pressure is measured by an inlet pressure transmitter located at the skid inlet. Alarm points associated with this flow signal include PI-NG-01—ANALOG INPUT, 4-20 mA, Natural Gas Inlet Pressure. Natural Gas inlet temperature (is measured by an inlet K type Thermocouple located at the skid inlet TI-NG-01—ANALOG INPUT, K-type Thermocouple (mV), Natural Gas Inlet Temperature.

The hydrogen gas flow control station regulates hydrogen gas flow rate throughout a flow range (5 to 30 vol or mol %). The hydrogen gas flow control station consists of flowmeter and flow control valve. The hydrogen flow control station is controlled by the blender PLC, such as the Allen-Bradley® ControlLogix PLC. Hydrogen gas flow is controlled by a two (2) PID control loop, active flow control loop and analyzer flow control loop.

The active flow control PID loop is feed forward control for hydrogen flowrate. The required hydrogen flow rate based on the selected blend is calculated in PLC utilizing three parameters, natural gas flowrate, user selected vol %, and hydrogen gas flow. The natural gas flowrate signal and hydrogen gas flow is hard-wired to the PLC from the natural gas flowmeter and hydrogen gas flowmeter respectively. Vol % is selected by the user in the PLC HMI panel. The PLC panel provide an option in HMI panel for user input Natural Gas Molecular weight. The hydrogen gas flow control controls the flow based on the flow calculation programmed in the PLC and hydrogen flowmeter 4-20 mA signal (Process Variable) in the PID loop. The flow PID controller provides 4-20 mA signal to the flow control valve. The flow control valve provides 4-20 mA valve position to the PLC.

The analyzer flow control PID loop is feedback control for the hydrogen flowrate. Hydrogen gas flow control controls the flow based on the user selected vol % in the HMI panel and hydrogen analyzer 4-20 mA signal (Process Variable) in the PID loop. Flow PID controller provides 4-20 mA signal to the flow control valve. The flow control valve provides 4-20 mA valve position to the PLC. The analyzer flow control PID loop is active only when natural gas flowrate signal is at steady state for 10 secs.

Hydrogen gas inlet temperature is measured by an inlet K type thermocouple located at the skid inlet TI-HG-01—ANALOG INPUT, K-type Thermocouple (mV), Hydrogen Gas Inlet Temperature. Hydrogen Gas regulated pressure is measured by a pressure transmitter located downstream of the pressure regulator. Alarm points associated with this flow signal include PI-HG-01—ANALOG INPUT, 4-20 mA, Hydrogen Gas Regulated Pressure PI-HG-01>set pressure, HMI ALARM—"HYDROGEN GAS REGULATED PRESSURE HIGH" Interlock SHUTDOWN—PCV-NG-01 (PY-NG-01=4 mA) SHUTDOWN—FCV-HG-01 (FY-HG-01=4 mA) PI-HG-01<set pressure for 10 sec, HMI ALARM—"HYDROGEN GAS REGULATED PRESSURE LOW" Interlock SHUTDOWN—PCV-NG-01 (PY-NG-01=4 mA) SHUTDOWN—FCV-HG-01 (FY-HG-01=4 mA).

Hydrogen Gas flow rate is measured by a flow meter and transmitter located upstream of the flow control valve. FI-HG-01—ANALOG INPUT, 4-20 mA, Hydrogen Gas Flow Rate. Hydrogen Gas or Blended Gas pressure is measured by a pressure transmitter located downstream of the flow control valve. PI-HG-02—ANALOG INPUT, 4-20 mA, Hydrogen Gas Discharge Pressure. Blended Gas temperature is measured by an outlet K type Thermocouple located at the skid outlet. TI-BG-01—ANALOG INPUT, K-type Thermocouple (mV), Blended Gas Temperature.

Blended Gas Hydrogen Analyzer provided at the skid discharge in the piping will provide Hydrogen vol % in the natural gas, as well as natural gas vol %. The Analyzer is provided with Ethernet/Modbus communication to communicate with the PLC, such as an Allen Bradley® PLC. The hydrogen analyzer has measuring range of 0-100% Hydrogen and 0-100% Natural Gas.

In some embodiments, the blender system can include a blended gas density meter provided at the skid discharge will provide blended gas density. Blended Gas density is measured by fork density meter. DI-BG-01—ANALOG INPUT, 4-20 mA, Blended Gas Density.

In some embodiments, the method of blending hydrogen gas includes the steps of: (i) confirming isolation valves are open; (ii) confirming 120V/3/60 power is available to the PLC panel; (iii) confirming PLC panel E-Stop is pulled IN; (iv) allowing HMI and PLC panel to come online; (v) starting opening the natural gas pressure control valve from PLC and maintain constant set discharge pressure (100 psig); (vi) calibrating the hydrogen analyzer based on the daily natural gas composition; (vii) once constant natural gas discharge pressure and flowrate is achieved, the skid is ready for hydrogen injection and blending; (viii) selecting the desired volumetric blend percentage in the PLC HMI screen; (ix) starting opening the hydrogen gas flow control valve from PLC with active flow control loop activated; (xi) if, one of the safety shutdown conditions exceeds its set point, the blending skid will shut down and send an alarm to the user control system (DCS/PLC/RTU/SCADA).

It is to be appreciated that the system and method may be installed and used under a variety of different conditions and for the blending, distribution, and transportation of a variety of different gases. Further, the system and method may be shipped fully assembled, fully or partially disassembled as will be readily appreciated by persons of ordinary skill in the art.

From the above description, it is clear that the inventive concepts disclosed herein are adapted to carry out the objects and to attain the advantages mentioned herein as well as those inherent in the inventive concepts disclosed herein. While exemplary embodiments of the inventive concepts disclosed herein have been described for purposes of this disclosure, it will be understood that numerous changes may be made which will readily suggest themselves to those skilled in the art and which are accomplished within the broad scope of the inventive concepts disclosed herein.

What is claimed is:

1. A system for blending hydrogen gas to produce a usable fuel, the system comprising:

a plurality of pipe segments;

one or more system controller; and a plurality of valves detachably connected to the plurality of pipe segments, the plurality of valves controlled by the system controller;

wherein the system controller automatically controls in real-time active flow of natural gas and active flow of hydrogen gas through the plurality of pipe segments to blend the hydrogen gas with the natural gas at a consistent blend of natural gas to hydrogen gas to produce a consistent stream of usable fuel.

2. The system of claim 1 wherein the plurality of pipe segments further comprise at least one inlet for receiving natural gas from a natural gas source, at least one inlet for receiving hydrogen gas from a hydrogen gas source and at least one outlet for producing the consistent stream of usable fuel comprising the consistent blend of natural gas to hydrogen gas.

3. The system of claim 1 wherein the system controller further comprises a display screen and a control panel.

4. The system of claim 1 wherein the plurality of valves further comprise a hydrogen gas flow control valve controlled by the system controller.

5. The system of claim 1 wherein the plurality of valves further comprise a natural gas pressure control valve controlled by the system controller.

6. The system of claim 1 further comprising one or more precision flow meters in communication with the system controller.

7. The system of claim 1 further comprising an inlet pressure regulator for controlling hydrogen inlet pressure.

8. The system of claim 1 further comprising a hydrogen analyzer controlled by the system controller.

9. The system of claim 1 wherein the system controller is a programmable logic controller having an automated software program running thereon, the automated software program programmed for providing customizable, modular, pre-programmed and custom programmed settings for automatically and selectively controlling real-time active flow of natural gas and real time active flow of hydrogen gas utilizing active real time feed-back data and active real time feed-forward data and pre-set data to blend hydrogen gas with natural gas at the consistent blend of natural gas to hydrogen gas to produce the consistent stream of usable fuel.

10. The system of claim 1, wherein the consistent blend of natural gas to hydrogen gas is 0-100%.

* * * * *